United States Patent [19]

Wright

[11] 4,337,872

[45] Jul. 6, 1982

[54] FURNACE BASKET

[76] Inventor: Dennis L. Wright, 911 Jamaica Dr., Fort Wayne, Ind. 46825

[21] Appl. No.: 141,179

[22] Filed: Apr. 17, 1980

[51] Int. Cl.[3] ..... B65D 6/08; B65D 6/32; B65D 21/02

[52] U.S. Cl. ..... 220/19; 206/513

[58] Field of Search ..... 220/19; 206/513

[56] References Cited

U.S. PATENT DOCUMENTS

| | | | |
|---|---|---|---|
| 1,936,164 | 11/1933 | Jarvis | 220/19 |
| 2,585,428 | 2/1952 | Bitney | 220/19 |
| 2,695,724 | 11/1954 | Averill | 220/19 |
| 3,014,612 | 12/1961 | Bruce | 220/19 |
| 3,160,308 | 12/1964 | Hare | 220/19 |
| 3,179,393 | 4/1965 | Bixby | 220/19 |

FOREIGN PATENT DOCUMENTS

| | | | |
|---|---|---|---|
| 1148450 | 4/1969 | United Kingdom | 220/19 |

*Primary Examiner*—George E. Lowrance
*Attorney, Agent, or Firm*—Gust, Irish, Jeffers & Hoffman

[57] ABSTRACT

A furnace basket having a flat bottom and an upright peripheral wall formed of a gridwork of transverse rods pressure welded together. The rod portions which form the wall are reinforced by means of peripheral rods welded thereto.

3 Claims, 3 Drawing Figures

FURNACE BASKET

BACKGROUND OF THE INVENTION

1. Field of the Invention

This invention is in the field of furnace baskets which are used to retain parts to be heat treated in high temperature heat treating furnaces.

2. Description of the Prior Art

Prior art furnace baskets are conventionally used to contain metal parts for heat treatment in a high temperature furnace. Such baskets have used a first and second plurality of parallel spaced rods that form a grid for the bottom with the intersections of the rods in the grid being arc or pressure welded. Further, the basket sides had upstanding bar pieces to which a perimetral rod which engaged the tops of the upstanding pieces was arcwelded. Due to the arc-welds, the baskets not only were expensive to manufacture but frequently fractured at the welds making frequent repairs necessary. The useful life of such prior art baskets was, thus, relatively short.

SUMMARY OF THE INVENTION

A first plurality of parallel, spaced rods of heat and corrosive resistant metal have each of the ends thereof formed into upturned portions. A second plurality of parallel, spaced rods also having their ends upturned and are laid over the first plurality of rods to form a grid, which is the basket bottom. The upturned portions define the sides or wall of the basket, and the ends of the upturned portions are substantially coplanar. The intersections of the rods are cross wire, resistance or pressure welded. A perimetral rod surrounds the wall and engages the upturned portions at the upper ends to be pressure welded thereto. One or more rods are disposed on the inner side of said wall in engagement with said upturned portions and are juxtaposed with respect to said perimetral rod. The inner rods are pressure welded to the upturned portions. A second perimetral rod also extends around the outside of the wall in pressure welded engagement with said upturned portions, this second rod being located in the central portion of the wall. All welds are pressure welds.

It has been found that the pressure welding adds substantially to the life of the basket, greatly reducing the need for basket repair. The basket is subjected to an extremely hostile environment in the heat treating furnace due to the high temperatures, temperature cycling, and chemical atmospheres. Notwithstanding these adverse conditions, baskets of this invention are durable and capable of supporting the heavy metal parts to be heat treated.

It is therefore an object of this invention to provide a sturdy, durable, furnace basket which is capable of withstanding the hostile furnace environment for supporting heat treated parts.

The above-mentioned and other features and objects of this invention and the manner of attaining them will become more apparent and the invention itself will be best understood by reference to the following description of an embodiment of this invention taken in conjunction with the accompanying drawings.

DESCRIPTION OF A PREFERRED EMBODIMENT

Figure 1:
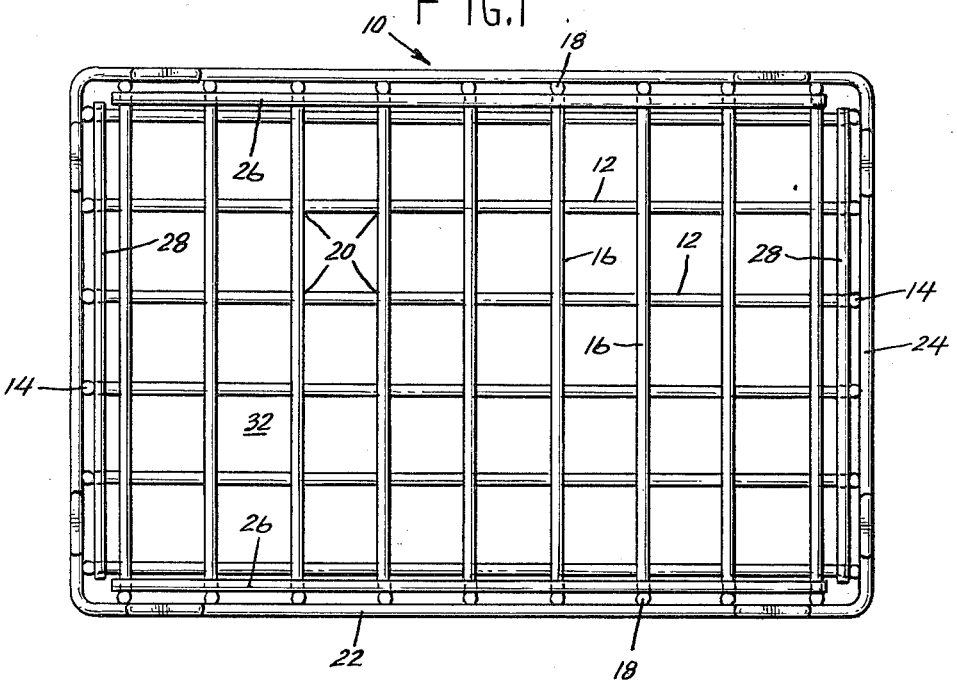
FIG. 1 is a top plan view of a preferred embodiment of this invention.

Referring to the drawing, a basket 10 has a plurality of first parallel spaced rods 12 bent to provide upturned end portions 14. A plurality of second parallel spaced rods 16 overlie and contact rods 12 to form a basekt bottom. Rods 16 are also bent to provide turned end portions 18. Each intersection 20 of rods 12 and 16 is cross wire-resistance or pressure welded. In this well known welding process, opposed welding electrodes are applied under pressure to opposite sides of the wires or rods to be welded and a high current passed therethrough. Due to the pressure and the heat developed by the electrical current, the parts in physical contact fuse and become welded together. Furnace baskets fabricated by this method are unusually durable and have exceptional strength.

Upturned portions 14 and 18 define the basket wall and the ends thereof are substantially coplanar. A perimetral reinforcing rod 22 surrounds the outside of the wall and is pressure welded to the upturned portions 14 and 18 adjacent the upper ends. The two ends of rod 22 are arc-welded at 24, this being the only arc-weld in the entire basket 10.

Four straight rods 26 and 28 are disposed on the inside of the basket wall in engagement with the upturned portions 18 and 14, respectively, and are welded thereto. The rods 26 and 28 are juxtaposed with respect to the perimetral rod 22 and sandwich the upper extremities of the upturned portions 14 and 18 therebetween. In the welding process, the rods 26, 28 and 22 are fixtured in position with respect to the upturned portions 14 and 18 and the assembly is pressure welded while so held. Such welding preferably is performed a step at a time at each intersection of rods 26, 28 and 22 with rods 14 and 18. It will be noted that the ends of the rods 26 and 28 are adjacent to each other at the corners of the basket wall.

Figure 2:
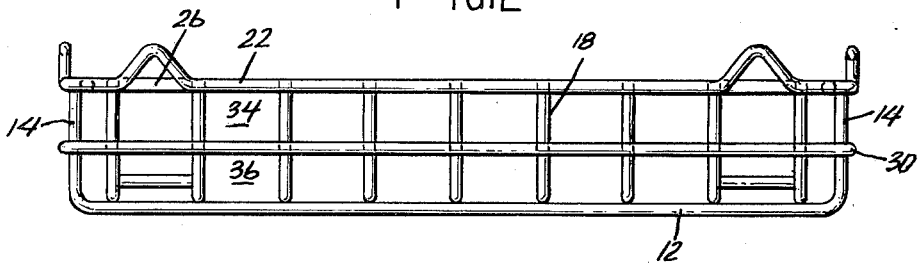
FIG. 2 is a side view of the embodiment of FIG. 1.
Figure 3:
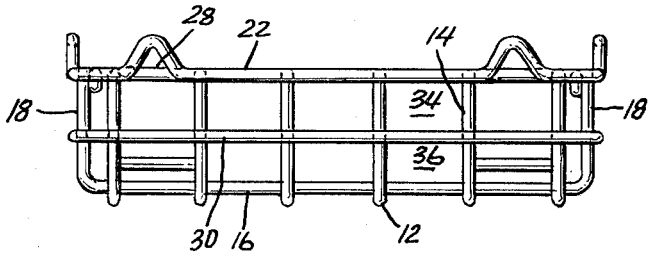
FIG. 3 is an end view.

Another perimetral reinforcing rod 30, sometimes referred to as a band rod, surrounds the exterior of the basket wall and is welded to each of the upturned portions 14 and 18 at the intersections. Both perimetral rods 22 and 30 define planes which are spaced apart and parallel, these in turn being parallel with the plane defined by the upper extremities of the upturned portions 14 and 18. These are further parallel to the bottom of the basket as shown in both FIGS. 2 and 3.

With all of the rods thus pressure welded together at the intersections, the bottom and sides of the basket are in the form of a grid having relatively large openings indicated by the numeral 32 in the bottom and the numerals 34 and 36 in the sides. It will be noted that since the perimetral rod 30 substantially bisects the upturned end portions 14 and 18, the openings 34 and 36 are substantially the same size.

The basket constructed as described and all of the rod intersections being pressure welded, a sturdy structure results which resists deformation even at the high temperatures encountered in the modern day, heat-treating furnaces. In prior art structures of a similar nature no perimetral rod or band 30 was provided. At the high temperatures encountered in heat-treating furnaces, the upturned portions of the rods which formed the wall or sides tended to bulge or distend outwardly under the force of the metal parts being heat-treated in the basket. Still, further, in such prior art baskets, the top of the wall tended to be the weakest part of the structure and under the distending forces of the metal parts contained within the basket and at the high heat-treating temperatures encountered, not infrequently the basket wall would either break or deform to such an extent as to require repair. By using the inner and outer perimetral rods 22 and 26,28 which sandwich the upturned rod portions 14 and 18 therebetween, a laminated structure results which provides a maximum of sturdiness and strength.

Cross wire-resistance or pressure welding provides fusion at the grain boundaries without producing grain growth as in the case with arc and similar types of welding. As a consequence, the resulting basket structure is stronger and more durable with regard to use in the hostile, carbonizing atmospheres employed in heat treating furnaces.

Pressure welding further results in reducing labor and consequent cost of manufacture and enables automating manufacture of the baskets. Pressure welding of the double top bar assembly 22, 26 and 28 also provides strength and durability in that portion of the basket which has in the past proven to be relatively weak and short lived, the type of weld coupled with this particular arrangement of parts further providing for these advantages.

As explained previously, the useful life of prior art baskets was relatively short. The reason for this is theorized as twofold: first the particular structural design was inadequate and second the filler-type weldments (e.g. arc weldments) were not as strong and deteriorated with repeated use.

Limiting consideration to furnace baskets, it was unrecognized until now that repeated heat-treating cycles (heating to high temperatures and then quenching) resulted in failure of the prior art weldments due to the relatively large grain structure in the fused region which tended to absorb carbon and nitrides from the furnace atmosphere. Recognition of this problem has lead to the solution of this invention, namely the fusion described obtained by pressure welding. The pressure weldment provides a grain structure unlike that of arc welding and a more homogeneous interface substantially like that of the rod material itself.

While pressure welding has been used heretofore in securing the crossed rods in the bottom of the basket, it has not been used throughout as in this invention, especially on the sides and at the basket perimeter. Baskets thus formed according to the method of this invention are thus superior resulting in an economy not heretofore available.

When a number of such baskets of equal size are used, they may be stacked one upon the other, the bottoms of the upper baskets resting upon the inner rods 26 and 28 of the lower ones. Thus baskets as disclosed may be conveniently used either in a stacked or non-stacked manner.

The rod material utilized in the fabrication of a working embodiment is preferably Inconel stainless alloy RA330 (35 NI 19CR). Spacing between rods 12 is three and one quarter inches center to center and spacing between rods 16 is three and one half inches center to center. The basket wall may be four, six, eight or ten inches high depending on the basket height desired. The length of the basket may be fourty-six inches and the width twenty-eight. The rods are ½ inch diameter.

While there have been described above the principles of this invention in connection with specific apparatus, it is to be clearly understood that this description is made only by way of example and not as a limitation to the scope of the invention.

What is claimed is:

1. A furnace basket comprising:

a plurality of first parallel spaced rods of substantially equal length having upturned end portions, a plurality of second parallel spaced rods of substantially equal length having upturned end portions, said second rods overlying and extending substantially perpendicular to said first rods to form a basket bottom and the upturned end portions defining a basket wall having four straight sides which join in corners, said first and second rods having pressure welds at the intersections thereof, a first perimetral rod extending around the outside of the basket wall in engagement with the upper ends of said upturned portions and being welded thereto, four rods being welded to said upturned portions on the inner side of said wall with spaces between ends of said inner rods adjacent rod corners, said inner rods being disposed opposite and parallel to said first perimetral rod thereby sandwiching said upturned portions therebetween, the top ends of the upturned portions being substantially coplanar with said perimetral and inner rods thereby defining a supporting ledge for a superposed basket, said bottom being flat and said wall being upright, said bottom lying in a plane parallel to the plane of said top ends and sandwiching rods, and a second perimetral rod also extending around the outside of the basket wall in the mid-portion thereof, in engagement with said upturned portions and being welded thereto, the intersections of all of said rods forming a grid pattern for said bottom and wall, the welds between rods being pressure welds characterized by fusion at the grain boundaries without grain growth.

2. The furnace basket of claim 1 wherein said wall and bottom are orthogonally shaped, said inner rods having adjacent ends at the corners of said wall, respectively.

3. The furnace basket of claim 2 wherein all of said rods are Inconer, stainless alloy.

* * * * *

UNITED STATES PATENT AND TRADEMARK OFFICE

CERTIFICATE OF CORRECTION

PATENT NO. : 4,337,872

DATED : July 6, 1982

INVENTOR(S) : Dennis L. Wright

It is certified that error appears in the above—identified patent and that said Letters Patent is hereby corrected as shown below:

Column 4, line 58, "Inconer" should be --Inconel--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*